US005611873A

United States Patent [19]

Yamada et al.

[11] Patent Number: 5,611,873

[45] Date of Patent: Mar. 18, 1997

[54] HIGH PRESSURE-LOW PRESSURE SINGLE CYLINDER TURBINE ROTOR AND METHOD OF MAKING

[75] Inventors: Masayuki Yamada, Kanagawa-ken; Yoichi Tsuda, Tokyo, both of Japan

[73] Assignee: Kabushiki Kaisha Toshiba, Kanagawa-ken, Japan

[21] Appl. No.: 413,156

[22] Filed: Mar. 29, 1995

[30] Foreign Application Priority Data

Mar. 30, 1994 [JP] Japan ..... 6-060596

[51] Int. Cl.[6] ..... C21D 8/10; C22C 38/44; C22C 38/46

[52] U.S. Cl. ..... 148/335; 148/547; 416/241 R; 420/109

[58] Field of Search ..... 148/335, 547; 420/109; 416/241 R

[56] References Cited

U.S. PATENT DOCUMENTS 5,437,742 8/1995 Siga et al. ..... 148/335

FOREIGN PATENT DOCUMENTS 50-14527 2/1975 Japan .
60-70166 4/1985 Japan .
60-245772 12/1985 Japan .
63-157839 6/1988 Japan .

OTHER PUBLICATIONS

M. Yamada et al.; Proceedings of the Robert I. Jaffee Memorial Symposium on Clean Materials Technology, ASM Materials Week, "HLP Single Cylinder Steam Turbine Rotor Forgings for Combined Cycle Power Plants"; pp. 161–168; Nov. 2, 1992.

Y. Tsuda et al.; Proceedings of JSME–ASME International Conference on Power Engineering–93, "Development of Advanced HLP Single Cylinder Steam Turbine Rotor Forgings"; pp. 91–96; Sep. 12, 1993.

*Primary Examiner*—Deborah Yee

*Attorney, Agent, or Firm*—Finnegan, Henderson, Farabow, Garrett & Dunner, L.L.P.

[57] ABSTRACT

A high pressure-low pressure single cylinder turbine rotor is disclosed which is characterized by being formed of a steel of a composition having, by weight, a C content of from 0.10 to 0.35%, a Si (silicon) content of not more than 0.3% (not including 0%), a Mn (manganese) content of not more than 1.0% (not including 0%), a Ni content of from 1.0 to 2.0%, a Cr (chromium) content of from 1.5 to 3.0%, a Mo content of from 0.9 to 1.3%, a V (vanadium) content of from 0.10 to 0.35%, a Nb (niobium) content of from 0.01 to 0.15%, a W content of from 0.1 to 1.5%, and the balance of Fe (iron) and inevitable impurities, the inevitable impurities having a P content of not more than 0.005%, a S content of not more than 0.001%, an As content of not more than 0.008%, a Sb content of not more than 0.004%, and a Sn content of not more than 0.008%.

8 Claims, 6 Drawing Sheets

HIGH PRESSURE-LOW PRESSURE SINGLE CYLINDER TURBINE ROTOR AND METHOD OF MAKING

BACKGROUND OF THE INVENTION

1. Field of the Invention

This invention relates to a high pressure-low pressure single cylinder turbine rotor and a method for the production thereof.

2. Description of the Related Art

Generally in a steam turbine, rotors of materials differing with working conditions of steam are used as combined. One example of the conventional steam turbine is shown in FIG. 6. In a large steam turbine, for example, a CrMoV steel exhibiting outstanding creep rupture strength at high temperatures is used as the material for the rotor operating on the high temperature-high pressure side (near 566° C., for example) 1 as specified by ASTM-A470 (Class 8). For the rotor operating on the low pressure side (at or below 350° C., for example), a NiCrMoV steel having a Ni content not less than 2.5% is used as specified in ASTM-A470 (Class 2 to 7). Then, these rotors which are made of materials differing with steam conditions are mechanically joined at a junction 3 to construct a steam turbine serving to rotate an electric generator 4. Since the conventional large steam turbine is constructed by joining a plurality of rotors made of different materials as described above, it has the drawback that the process of manufacture is complicated, the floor space for the installation of the turbine proper as a whole is large, and the cost of the plant is inevitably great.

In contrast, in a relatively small steam turbine (a power generating plant of an output of not more than 100 MW), a high pressure-low pressure single cylinder rotor made of one and the same material is generally used as extended from the high pressure side through the low pressure side. As the material for the conventional high pressure-low pressure single cylinder rotor, a CrMoV steel, a NiCrMoV steel, and a 1CrMoVNiNb steel are generally used.

In a power generating plant having an output exceeding 100 MW, however, the use of a steam turbine incorporating a high pressure-low pressure single cylinder rotor entrains the following problem. One example of the steam turbine using a high pressure-low pressure single cylinder rotor is shown in FIG. 7. With reference to FIG. 7, the high pressure part 1 of the steam turbine rotor is used in an environment of high temperature exceeding 500° C. and the downstream side portion of the high pressure part 1 and the upstream side portion of the low pressure part 2 are used in a temperature range of from 350° to 450° C. The CrMoV steel heretofore used as the material for the high pressure-low pressure single cylinder rotor, therefore, is not fully satisfactory in terms of tensile strength and toughness. Though the NiCrMoV steel excels in tensile strength, it nevertheless has the problem that it is deficient in creep rupture strength and is liable to succumb to embrittlement in a temperature range exceeding 350° C. Then, the 1CrMoVNiNb steel is hardly satisfactory in terms of tensile strength and toughness. A 12Cr steel has been already developed as the rotor material excelling in creep rupture strength and toughness and in tensile strength in a low temperature range as well. Since this 12Cr steel is expensive, the use of this alloy as the material for a rotor entrains the problem of increasing the cost of production. The circumstance has urged development of an alloy which incorporates W besides Ni, Cr, Mo, V, or the like and further incorporates B and N (JP-A-63-157, 839).

A high pressure-low pressure single cylinder turbine rotor which is capable of retaining such creep rupture strength as is required in a high pressure part and meanwhile repressing the loss of strengths (tensile strength and creep rupture strength) due to aging and also capable of retaining such toughness and tensile strength as are required in a low pressure part and meanwhile repressing the decline of toughness (embrittlement) due to aging and consequently usable at a power generating plant of an output exceeding 100 MW remains yet to be developed.

SUMMARY OF THE INVENTION

The first object of this invention resides in providing a high pressure-low pressure single cylinder turbine rotor which exhibits high tensile strength under the steam condition of a relatively low temperature and high creep rupture strength under the condition of a high temperature. The turbine rotor of this kind permits use of steam of a high temperature on the high temperature-high pressure side and, at the same time, allows equipment of the low pressure side thereof with an elongate last-stage bucket. It, therefore, contributes to enhance the efficiency of a steam turbine.

The second object of this invention resides in providing a high pressure-low pressure single cylinder turbine rotor which operates infallibly for a long time while retaining high tensile strength and creep rupture strength without incurring the phenomenon of embrittlement. The turbine rotor of this kind is safe from the problem of gradual degradation of tensile strength and creep rupture strength due to a protracted service under an environment of a high temperature exceeding 500° C. and the problem of gradual development of the phenomenon of embrittlement due to a continual service in a temperature range of from 350° to 450° C. As a result, this turbine rotor proves advantageous also from the economic point of view.

The third object of this invention resides in providing a high pressure-low pressure single cylinder turbine rotor which is capable of repressing segregation of components, C (carbon) in particular among others, of the material forming the central part of a rotor and a method for the production of the turbine rotor. The turbine rotor of this kind, owing to the improvement in the method for production thereof, is enabled to repress the componential segregation of C (carbon) which is liable to occur in the central part of a rotor when the content of inevitable impurities in a low alloy steel is lowered.

The high pressure-low pressure single cylinder turbine rotor is required to repress the gradual decline of strengths (tensile strength and creep rupture strength) without a sacrifice of creep rupture strength in the high pressure part thereof and, at the same time, repress the gradual degradation of toughness (namely the development of embrittlement) without a sacrifice of toughness and tensile strength in the low pressure part thereof. The present inventors, after remarking that the three elements, Ni (nickel), Mo (molybdenum), and W (tungsten), among other alloy elements bear heavily on the essential requirements mentioned above, have made a study devoted to the determination of their optimum concentrations. It has been further ascertained to them that these essential requirements are greatly affected not only by kinds and quantities of alloy elements but also by quantities of inevitable impurities. It has been also found that the componential segregation, particularly that of C (carbon), in the central part of a steel block, namely the central part of a rotor, is markedly repressed when ESR is adopted as a remelting technique in addition to the standard melting and refining steps.

When a high pressure-low pressure single cylinder rotor is used in an environment of a high temperature exceeding 500° C., the fine grains of carbide contained in the alloy material of the rotor and contributing to the fortification of the alloy material aggregate into coarse grains and tend toward gradually decreasing this contribution and inciting decline of tensile strength and creep rupture strength. When it is used in a temperature range of from 350° to 450° C., the impurities contained in the alloy material of the rotor tend to gather in grain boundaries, namely to induce the so-called grain boundary segregation, to the extent of enervating the interatomic binding force in the grain boundaries and eventually inducing the phenomenon of embrittlement. The inventors, on the basis of this knowledge, have succeeded in notably decreasing the amount of grain boundary segregation and, at the same time, markedly repressing the gradual degradation of strength and toughness by finding the Ni content in the range of from 1.0 to 2.0%, the Mo content in the range of from 0.9 to 1.3%, and the W content in the range of from 0.1 to 1.5% and, at the same time, setting the P (phosphorus) content at or below 0.005%, the S (sulfur) content at or below 0.001%, the As (arsenic) content at or below 0.008%, the Sb (antimony) content at or below 0.004%, and the Sn (tin) content at or below 0.008% in the inevitable impurities contained in the alloy. This alloy composition enables the high pressure-low pressure single cylinder rotor to secure lasting stability, enjoy elongation of service life, eliminate the danger of brittle rupture, and provide lasting service stably.

To be specific, the high pressure-low pressure single cylinder turbine rotor of this invention is characterized by being formed of a steel of a composition having, by weight, a C content of from 0.10 to 0.35%, a Si (silicon) content of not more than 0.3% (not including 0%), a Mn (manganese) content of not more than 1.0% (not including 0%), a Ni content of from 1.0 to 2.0%, a Cr (chromium) content of from 1.5 to 3.0%, a Mo content of from 0.9 to 1.3%, a V (vanadium) content of from 0.10 to 0.35%, a Nb (niobium) content of from 0.01 to 0.15%, a W content of from 0.1 to 1.5%, and the balance of Fe (iron) and inevitable impurities, the inevitable impurities having a P content of not more than 0.005%, a S content of not more than 0.001%, an As content of not more than 0.008%, a Sb content of not more than 0.004%, and a Sn content of not more than 0.008%.

The steel which has such a composition as is mentioned above is characterized by possessing as characteristic values thereof tensile strength of from 86 to 92 kgf/mm$^2$, FATT of not more than 70° C., and rupture time of not less then 2500 hours under the creep conditions of 600° C.×14 kgf/mm$^2$.

Further, the high pressure-low pressure single cylinder turbine rotor of this invention is characterized by being produced by the use of the electroslag remelting (ESR) method as a remelting technique.

The ESR designates a method which comprises melting a consumable electrode with the heat of the electrical resistance of a fused slag and continuously solidifying the melt in a water-cooled copper mold. The casting method using the ESR is known to bring about the following effects.

1) The solidified texture is improved because, during the course of solidification, the non-metallic inclusions are trapped and consequently the phenomenon of so-called V segregation and inverse V segregation, i.e. the occurrence of segregation spots of the shape of the letter V or the inverted letter V in the ingot, is repressed.

2) The cast ingot acquires a clean skin.

3) The removal of non-metallic inclusions is attained satisfactorily because of the repression of the phenomenon of V segregation and inverse V segregation.

4) The refining action of the slag facilitates such reactions as desulfurization and deoxidation.

The present inventors have acquired a new knowledge that when an ingot prepared for the rotor has the composition of this invention and the ESR is applied to this ingot, the componential segregation in the central part of the rotor made of the ingot is notably curbed. Notwithstanding the ingot which has the composition of this invention is relatively more liable to induce the componential segregation in the central part of the rotor, the inventors' new knowledge of the operation and effect of the ESR has enabled the high pressure-low pressure single cylinder turbine rotor, of this invention to acquire exceptionally find characteristics.

DESCRIPTION OF THE PREFERRED EMBODIMENTS

Figure 1:
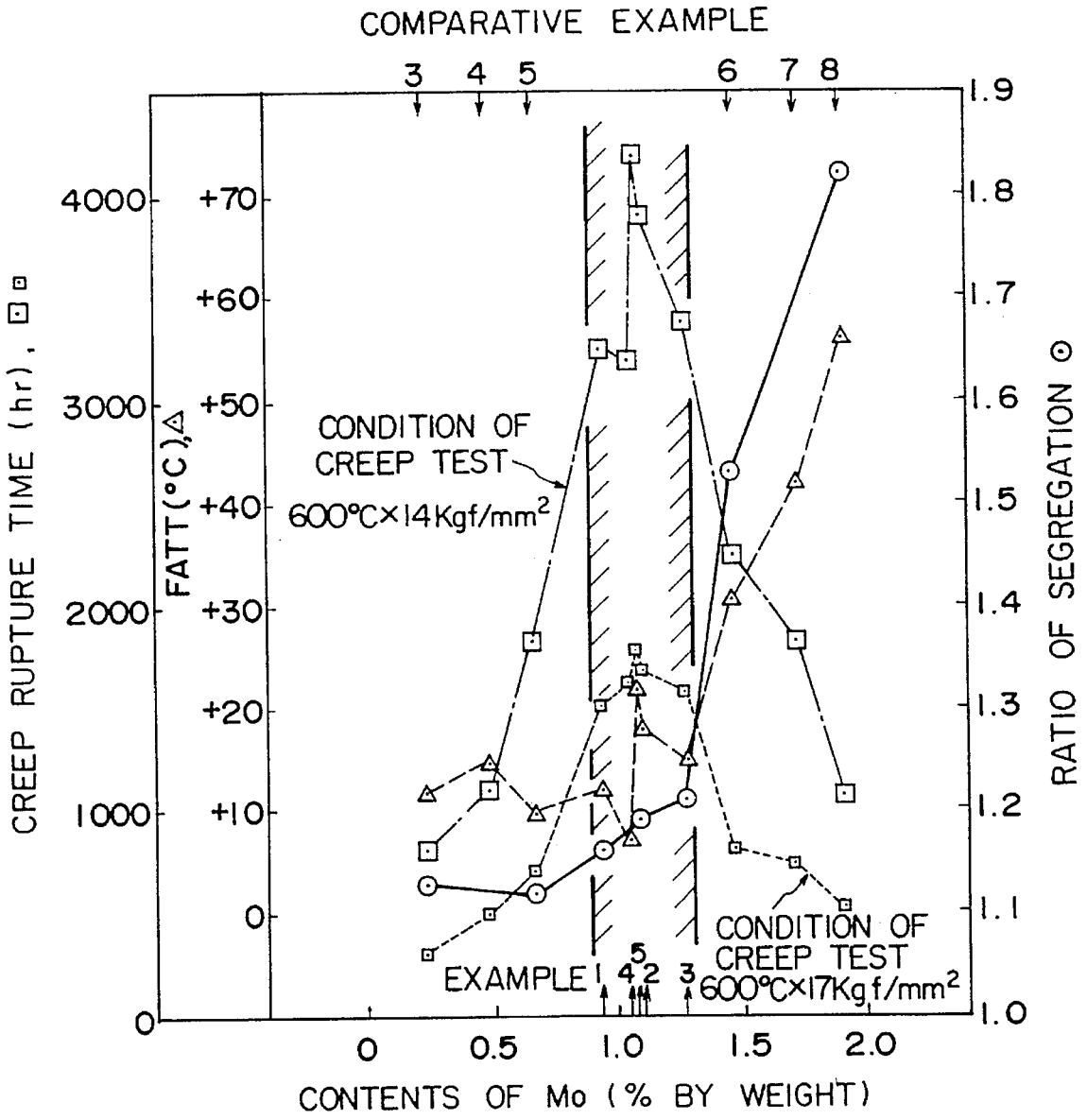
FIG. 1 is a diagram showing the results of the correlation of FATT, creep rupture time, and "segregation ratio" severally to the Mo content.

The purposes of the incorporation of component elements to be used in the embodiments of this invention and the reasons for the limits imposed on the component elements of the composition will be described below. The denomination of "%" which is used hereinbelow refers invariably to "% by weight."

Ni (nickel) is an element for forming austenite and is effective in stabilizing the austenite phase during the heating phase of the quenching treatment and preventing the formation of a ferrite phase during the cooling phase of the quenching treatment. It is further effective in enhancing tensile strength and toughness. For the high pressure-low pressure single cylinder turbine rotor of this invention to acquire necessary tensile strength and toughness, nickel is required to be incorporated in a concentration of not less than 1.0%. If the nickel concentration exceeds 2.0%, however, the excess nickel will rather tend to lower the creep rupture strength and promote the embrittlement. Thus, the amount of nickel to be incorporated is in the range of from 1.0 to 2.0%, preferably from 1.3 to 1.8%.

Mo (molybdenum) is an element which is effective in exalting the hardenability of steel and heightening the tensile strength and the creep rupture strength thereof. For the high pressure-low pressure single cylinder turbine rotor of this invention to acquire necessary tensile strength and creep rupture strength, molybdenum is required to be incorporated in a concentration of not less than 0.9%. If the molybdenum concentration exceeds 1.3%, the excess molybdenum will not only lower the creep rupture strength instead but also degrade the toughness conspicuously. Besides, the componential segregation, particularly that of C (carbon) in particular, in the central part of the turbine rotor is caused to grow in prominence. The molybdenum concentration, therefore, is in the range of from 0.9 to 1.3%, preferably from 1.0 to 1.2%.

The expression "componential segregation of C (carbon" as used herein refers to a phenomenon that the concentration of the C (carbon) component varies according to the site in the ingot. An ingot begins to solidify from the peripheral part and the bottom part of an ingot case (mold) and this solidification gradually proceeds inward. The central part and the upper part are solidified finally. In the ingot of the composition of this invention, the phenomenon of the segregation of carbon component occurs prevalently in the central part of the ingot, though variable with the composition of the material. Specifically, this componential segregation gains in concentration in the part overlying the central part. It is suspected that when this componential segregation occurs conspicuously in a given material, the material will have the characteristics thereof altered and will fail to fulfil the specifications set for a large rotor. In the selection of components for the material of an ingot, therefore, it is necessary that consideration be given to repressing the componential segregation to the fullest possible extent. The degree of segregation in a given species of steel can be determined by actually preparing an ingot of the particular species of steel, taking samples of an upper and a lower portion of the central part of the ingot, analyzing the samples for C content, and rating the ratio of the two C contents. In the composition contemplated by this invention, the componential segregation of C (carbon) becomes conspicuous when the molybdenum concentration therein exceeds 1.3%.

W (tungsten) is an element which is effective in fortifying solid solution and consequently enhancing high-temperature strength. For the tungsten to manifest this effect, it is required to be incorporated in an amount of not less than 0.1%. If this amount exceeds 1.5%, however, the excess will go to lower toughness. Thus, the amount of tungsten is in the range of from 0.1 to 1.5%, preferably from 0.2 to 0.8%.

Such characteristic properties as toughness, creep rupture strength, and tensile strength which bear on this invention can be evaluated by the tension test, the Charpy impact test, and the creep rupture test which will be specifically described hereinbelow.

The tensile test is intended to be performed on a given sample for the purpose of determining tensile strength, 0.2% proof stress, elongation, and reduction of area of the sample. The desirability of any of these properties augments in proportion as the magnitude of the property increases. The tensile properties (tensile strength, 0.2% proof stress, elongation, and reduction of area) of a given sample at varying temperatures can be obtained by varying the temperature environment of the sample.

The Charpy impact test is intended to be performed on a given sample for the purpose of determining magnitude of impact and FATT (fracture appearance transition temperature) (ductility.brittleness transition temperature found from the fracture ratio of the sample) of the sample. Generally, the expression "magnitude of impact" is used to imply the property which is manifested at normal room temperature (20° C.). The magnitude of impact (the difficulty with which a sample is broken by a force of impact, namely the magnitude of toughness) is such that the desirability thereof, similarly to tensile properties, augments in proportion as the magnitude thereof increases. The ingot conforming to this invention has its magnitude of impact varied by temperature; one same sample of the ingot manifests a large magnitude of impact and assumes a ductile fracture in a high temperature range, whereas it manifests a small magnitude of impact and assumes a brittle fracture in a low temperature range. In an intermediate temperature range, this sample simultaneously assumes a ductile fracture and a brittle fracture. Through the measurement of the areas of these two fractures, the temperature at which the ratio of these areas is exactly 50%–50% is determined. This temperature is noted down as FATT. The magnitude of toughness, therefore, increases in proportion as the magnitude of FATT decreases.

The creep rupture test is intended to be performed on a given sample for the purpose of determining creep rupture strength of the sample. The creep rupture strength is a property corresponding to creep rupture time. The magnitude of creep rupture strength augments in proportion as the length of creep rupture time increases.

This invention concerns a Fe-based alloy of a specific composition comprising C, Si, Mn, Cr, V, and Nb in addition to the optimum contents of inevitable impurities, Ni, Mo, and W.

The purposes of the incorporation of these component elements and the reasons for the limits imposed on the component elements of the composition will be described below.

C (carbon) functions to stabilize an austenite phase during the quenching treatment and further give rise to a carbide and enhance tensile strength. For the sake of this function, it is required to be incorporated in an amount of not less than 0.10%. If this amount exceeds 0.35%, however, the carbide is formed excessively and, as a result, the tensile strength is lowered and the toughness is degraded as well. Thus, the amount of carbon to be incorporated is in the range of from 0.10 to 0.35%, preferably from 0.18 to 0.30%.

Si (silicon) is incorporated to discharge the function of a deacidifying agent during the course of melting. If it is incorporated in an unduly large amount, however, the excess will remain in the form of an oxide in steel and exert an adverse effect on toughness. Thus, the amount of silicon to be incorporated is not more than 0.3%, preferably not more than 0.1%.

Mn (manganese) is incorporated to discharge the function of a deacidifying and desulfurizing agent during the course of melting. If it is incorporated in an unduly large amount, the excess will degrade toughness. Thus, the amount of manganese to be incorporated is not more than 1.0%, preferably not more than 0.7%.

Cr (chromium) is an element necessary for preventing oxidation and, at the same time, enhancing tensile strength and toughness. For this purpose, it is required to be incorporated in an amount of not less than 1.5%. If this amount exceeds 3.0%, however, the excess will degrade toughness and tensile strength and, at the same time, lower journal property. Thus, the amount of chromium to be incorporated is in the range of from 1.5 to 3.0%, preferably from 1.8 to 2.5%.

V (vanadium) is an element which is effective in enhancing hardenability of steel and exalting creep rupture strength. It is also effective in attaining fine division of crystal grains. To manifest these effects, it is required to be incorporated in an amount of not less than 0.10%. If this amount exceeds 0.35%, however, the excess will degrade toughness and tensile strength. Thus, the amount of vanadium to be incorporated is in the range of from 0.10 to 0.35%, preferably from 0.15 to 0.30%.

Nb (niobium) is an element which is effective in effecting fine division of crystal grains. To manifest this effect, it is required to be incorporated in an amount of not less than 0.01%. If this amount exceeds 0.15%, however, the excess will induce formation of coarse carbonitride particles and lower toughness. Thus, the amount of niobium to be incorporated is in the range of from 0.01 to 0.15%, preferably from 0.02 to 0.10%.

Now, working examples of this invention will be described hereinbelow together with Comparative Examples.

The formulations used for Examples 1 through 14 are shown in Table 1 and those used for Comparative Examples 1 through 18 in Table 2. The reasons for fixing the proportions of components used in Examples 1 through 14 and in Comparative Examples 1 through 18 are as follows.

Examples 1 through 5 pertain to species of steel having the contents of C, Si, Mn, Ni, Cr, V, Nb, and W fixed and the amount of Mo varied for the purpose of improving creep rupture strength and toughness. Examples 6 through 9 pertain to species of steel having the contents of C, Si, Mn, Cr, Mo, V, Nb, and W fixed and the amount of Ni varied for the purpose of improving creep rupture strength and toughness and repressing componential segregation.

Examples 10 through 14 pertain to species of steel having the contents of C, Si, Mn, Ni, Cr, Mo, V, and Nb fixed and the amount of W varied for the purpose of improving creep rupture strength and toughness and repressing componential segregation.

The composition of Comparative Example 1 corresponds to the 1% CrMoV steel which has been heretofore used in high temperature grade turbine rotors at thermoelectric power plants. The composition of Comparative Example 2 corresponds to the 3.5% NiCrMoV steel which has been heretofore used in low temperature grade turbine rotors at thermoelectric power plants. The composition of Comparative Example 18 corresponds to the 1% CrMoVNiNb steel which has been heretofore used in high pressure-low pressure single cylinder rotors for relatively small steam turbines (power generation plants of outputs of not more than 100 MW). These species of steel invariably contain P, S, As, Sb, and Sn among other inevitable impurities in larger amounts than in the species of steel of Examples 1 through 14.

Comparative Examples 3 through 17 pertain to species of steel which are not used as materials for existing turbine rotors but have been manufactured particularly for the purpose of studying the effects of Ni, Mo, and W.

Specifically, Comparative Examples 3 through 8 pertain to species of steel having various Mo contents above the upper limit or below the lower limit of the Mo contents in the species of steel of Examples 1 through 5. Comparative Examples 9 through 13 pertain to species of steel having various Ni contents above the upper limit or below the lower limit of the Ni contents in the species of steel of Examples 6 through 9. Comparative Examples 14 through 17 pertain to species of steel having various W contents above the upper limit or below the lower limit of the W contents in the species of steel of Examples 10 through 14.

TABLE 1

| | Chemical composition (% by wight) | | | | | | | | | | | | | | |
|---|---|---|---|---|---|---|---|---|---|---|---|---|---|---|---|
| Example | C | Si | Mn | Ni | Cr | Mo | V | Nb | W | P | S | As | Sb | Sn | Fe |
| 1 | 0.25 | 0.05 | 0.55 | 1.64 | 2.20 | 0.94 | 0.22 | 0.03 | 0.61 | 0.003 | 0.0005 | 0.004 | 0.001 | 0.004 | Balance |
| 2 | 0.24 | 0.07 | 0.46 | 1.65 | 2.23 | 1.10 | 0.23 | 0.02 | 0.59 | 0.003 | 0.0006 | 0.004 | 0.001 | 0.003 | Balance |
| 3 | 0.24 | 0.07 | 0.43 | 1.74 | 2.21 | 1.27 | 0.24 | 0.03 | 0.48 | 0.002 | 0.0005 | 0.006 | 0.002 | 0.004 | Balance |
| 4 | 0.24 | 0.07 | 0.42 | 1.70 | 2.24 | 1.05 | 0.22 | 0.03 | 0.23 | 0.003 | 0.0007 | 0.006 | 0.001 | 0.005 | Balance |
| 5 | 0.23 | 0.06 | 0.46 | 1.73 | 2.23 | 1.08 | 0.22 | 0.02 | 1.02 | 0.004 | 0.0008 | 0.005 | 0.002 | 0.004 | Balance |
| 6 | 0.24 | 0.08 | 0.47 | 1.11 | 2.26 | 1.21 | 0.19 | 0.03 | 0.33 | 0.003 | 0.0005 | 0.006 | 0.002 | 0.004 | Balance |
| 7 | 0.23 | 0.07 | 0.53 | 1.33 | 2.21 | 1.20 | 0.22 | 0.02 | 0.29 | 0.002 | 0.0006 | 0.004 | 0.002 | 0.005 | Balance |
| 8 | 0.23 | 0.06 | 0.58 | 1.59 | 2.23 | 1.16 | 0.24 | 0.02 | 0.31 | 0.002 | 0.0007 | 0.004 | 0.002 | 0.004 | Balance |
| 9 | 0.23 | 0.05 | 0.49 | 1.90 | 2.18 | 1.18 | 0.20 | 0.02 | 0.30 | 0.003 | 0.0006 | 0.004 | 0.001 | 0.004 | Balance |
| 10 | 0.25 | 0.08 | 0.48 | 1.65 | 2.20 | 1.21 | 0.22 | 0.03 | 0.11 | 0.002 | 0.0008 | 0.005 | 0.001 | 0.005 | Balance |
| 11 | 0.26 | 0.07 | 0.53 | 1.67 | 2.23 | 1.22 | 0.23 | 0.02 | 0.41 | 0.004 | 0.0006 | 0.005 | 0.002 | 0.004 | Balance |
| 12 | 0.25 | 0.06 | 0.47 | 1.73 | 2.20 | 1.20 | 0.22 | 0.02 | 0.82 | 0.003 | 0.0007 | 0.004 | 0.001 | 0.005 | Balance |
| 13 | 0.24 | 0.05 | 0.52 | 1.71 | 2.18 | 1.14 | 0.19 | 0.03 | 1.30 | 0.003 | 0.0006 | 0.006 | 0.002 | 0.004 | Balance |
| 14 | 0.23 | 0.08 | 0.55 | 1.68 | 2.22 | 1.17 | 0.20 | 0.03 | 1.39 | 0.002 | 0.0007 | 0.005 | 0.002 | 0.004 | Balance |

TABLE 2

| Comparative | Chemical composition (% by weight) | | | | | | | | | | | | | | |
|---|---|---|---|---|---|---|---|---|---|---|---|---|---|---|---|
| Example | C | Si | Mn | Ni | Cr | Mo | V | Nb | W | P | S | As | Sb | Sn | Fe |
| 1 | 0.29 | 0.07 | 0.77 | 0.34 | 1.10 | 1.15 | 0.22 | — | — | 0.007 | 0.0040 | 0.010 | 0.008 | 0.012 | Balance |
| 2 | 0.24 | 0.08 | 0.23 | 3.56 | 1.84 | 0.39 | 0.12 | — | — | 0.006 | 0.0034 | 0.012 | 0.007 | 0.009 | Balance |
| 3 | 0.25 | 0.07 | 0.51 | 1.72 | 2.21 | 0.23 | 0.22 | 0.03 | 0.51 | 0.004 | 0.0008 | 0.006 | 0.002 | 0.005 | Balance |
| 4 | 0.22 | 0.06 | 0.38 | 1.66 | 2.17 | 0.48 | 0.25 | 0.02 | 0.45 | 0.003 | 0.0009 | 0.005 | 0.001 | 0.004 | Balance |
| 5 | 0.28 | 0.08 | 0.44 | 1.62 | 2.28 | 0.67 | 0.23 | 0.02 | 0.61 | 0.004 | 0.0008 | 0.006 | 0.001 | 0.004 | Balance |
| 6 | 0.27 | 0.09 | 0.32 | 1.78 | 2.20 | 1.46 | 0.24 | 0.03 | 0.55 | 0.003 | 0.0005 | 0.004 | 0.002 | 0.005 | Balance |

TABLE 2-continued

| Comparative Example | Chemical composition (% by weight) | | | | | | | | | | | | | | |
|---|---|---|---|---|---|---|---|---|---|---|---|---|---|---|---|
| | C | Si | Mn | Ni | Cr | Mo | V | Nb | W | P | S | As | Sb | Sn | Fe |
| 7 | 0.24 | 0.06 | 0.55 | 1.71 | 2.31 | 1.72 | 0.22 | 0.03 | 0.50 | 0.003 | 0.0006 | 0.005 | 0.002 | 0.003 | Balance |
| 8 | 0.25 | 0.07 | 0.48 | 1.70 | 2.19 | 1.91 | 0.23 | 0.03 | 0.57 | 0.004 | 0.0007 | 0.006 | 0.001 | 0.005 | Balance |
| 9 | 0.22 | 0.07 | 0.52 | 0.31 | 2.15 | 1.03 | 0.20 | 0.03 | 0.30 | 0.003 | 0.0006 | 0.007 | 0.001 | 0.004 | Balance |
| 10 | 0.22 | 0.06 | 0.60 | 0.52 | 2.22 | 0.98 | 0.23 | 0.03 | 0.31 | 0.004 | 0.0007 | 0.006 | 0.002 | 0.004 | Balance |
| 11 | 0.25 | 0.08 | 0.63 | 0.72 | 2.20 | 0.99 | 0.19 | 0.02 | 0.28 | 0.004 | 0.0007 | 0.005 | 0.002 | 0.005 | Balance |
| 12 | 0.27 | 0.05 | 0.58 | 2.31 | 2.21 | 1.12 | 0.20 | 0.02 | 0.30 | 0.004 | 0.0008 | 0.006 | 0.001 | 0.004 | Balance |
| 13 | 0.26 | 0.07 | 0.56 | 2.63 | 2.18 | 1.13 | 0.21 | 0.03 | 0.30 | 0.003 | 0.0007 | 0.005 | 0.001 | 0.005 | Balance |
| 14 | 0.27 | 0.07 | 0.47 | 1.72 | 2.19 | 1.08 | 0.22 | 0.03 | — | 0.003 | 0.0006 | 0.006 | 0.002 | 0.004 | Balance |
| 15 | 0.22 | 0.08 | 0.55 | 1.67 | 2.16 | 1.03 | 0.20 | 0.02 | 0.05 | 0.002 | 0.0007 | 0.007 | 0.001 | 0.004 | Balance |
| 16 | 0.25 | 0.05 | 0.61 | 1.66 | 2.22 | 1.11 | 0.23 | 0.02 | 1.70 | 0.004 | 0.0007 | 0.004 | 0.001 | 0.005 | Balance |
| 17 | 0.24 | 0.06 | 0.58 | 1.70 | 2.24 | 1.08 | 0.25 | 0.02 | 2.01 | 0.003 | 0.0006 | 0.005 | 0.002 | 0.005 | Balance |
| 18 | 0.26 | 0.06 | 0.65 | 0.95 | 1.03 | 1.21 | 0.25 | 0.03 | — | 0.005 | 0.0035 | 0.010 | 0.007 | 0.010 | Balance |

The raw materials prepared in amounts according to the formulation of each example or each Comparative Example were melted in a high frequency vacuum melting furnace and the melt was poured in a mold to obtain an ingot. This ingot was machined to shave off the surface thereof, set in place in a heavy oil furnace, and heated to 1200° C. and press forged to obtain a forged and elongated round bar 30 mm in diameter.

Then, this round bar was subjected to a annealing treatment preparatory to refining, a quenching treatment, and a tempering treatment. The conditions of these treatments are shown in Table 3. The annealing treatment preparatory to refining indicated in Table 3 has the role of relieving the texture of heterogeneity caused by forging and, at the same time, inducing a coarse heterogeneous carbide to form a solid solution in the matrix and enabling the steel obtained in consequence of the annealing and the tempering treatment to acquire improved material properties. Though the effectiveness of this treatment with respect to the role mentioned above rises in proportion as the temperature used for the treatment increases, the practical upper limit of the temperature, 1100° C., was adopted for the treatment in question.

The heating for the quenching treatment serves the purpose of causing such carbide forming elements as Cr, Mo, and V to be temporarily converted into a solid solution in the matrix thereby adjusting grain size and attaining uniform fine precipitation of carbide during the tempering treatment. The quenching for the existing high pressure rotor (Comparative Example 1) is carried out at 970° C. and that for the existing low pressure rotor (Comparative Example 2) at 840° C. Since the steel of this invention is intended for a high pressure-low pressure single cylinder turbine rotor, an intermediate temperature 930° C. between the quenching temperatures of the two rotors mentioned above was selected as an example.

The cooling for the quenching treatment was carried out at a temperature decreasing rate of about 100° C./h, which is the standard cooling rate obtained in the central part of an ordinary large low pressure rotor having a maximum diameter of 1650 mm when this rotor is cooled by water spraying.

The tempering temperature, similarly to the quenching temperature, was set at an intermediate temperature 650° C. between the tempering temperatures 670° C. and 600° C. used respectively for the existing high pressure rotor and the existing low pressure rotor. The heating time for the tempering treatment was varied with species of steel so that the tensile strength at normal room temperature would fall at a level of 87 to 90 kgf/mm$^2$ necessary for the low pressure part. These conditions were selected for the purpose of adjusting the tensile strength at a practically fixed level and rating and comparing such factors as proof stress, impact properties (particularly FATT: fracture appearance transition temperature), and creep rupture strength which are necessary for a high pressure-low pressure single cylinder turbine rotor. This rating permits comparison of materials of different components.

TABLE 3

| | Annealing treatment preparatory to quality heat treatment*1 annealing temperature (°C.) | Quenching treatment*2 Quenching temperature (°C.) | Tempereing treatment tempering temperature (°C.) |
|---|---|---|---|
| Example | | | |
| 1 | 1100 | 930 | 650 × 21 h, cooled by air |
| 2 | 1100 | 930 | 650 × 22 h, cooled by air |
| 3 | 1100 | 930 | 650 × 24 h, cooled by air |
| 4 | 1100 | 930 | 650 × 20 h, cooled by air |
| 5 | 1100 | 930 | 650 × 25 h, cooled by air |
| 6 | 1100 | 930 | 650 × 22 h, cooled by air |
| 7 | 1100 | 930 | 650 × 22 h, cooled by air |
| 8 | 1100 | 930 | 650 × 24 h, cooled by air |
| 9 | 1100 | 930 | 650 × 26 h, cooled by air |
| 10 | 1100 | 930 | 650 × 18 h, cooled by air |
| 11 | 1100 | 930 | 650 × 20 h, cooled by air |
| 12 | 1100 | 930 | 650 × 25 h, cooled by air |
| 13 | 1100 | 930 | 650 × 30 h, cooled by air |
| 14 | 1100 | 930 | 650 × 31 h, cooled by air |
| Comparative Example | | | |
| 1 | 1100 | 970 | 670 × 20 h, cooled by air |
| 2 | 950 | 840 | 600 × 20 h, cooled by air |
| 3 | 1100 | 930 | 650 × 15 h, cooled by air |

TABLE 3-continued

| | Annealing treatment preparatory to quality heat treatment*1 annealing temperature (°C.) | Quenching treatment*2 Quenching temperature (°C.) | Tempereing treatment tempering temperature (°C.) |
|---|---|---|---|
| 4 | 1100 | 930 | 650 × 18 h, cooled by air |
| 5 | 1100 | 930 | 650 × 18 h, cooled by air |
| 6 | 1100 | 930 | 650 × 25 h, cooled by air |
| 7 | 1100 | 930 | 650 × 27 h, cooled by air |
| 8 | 1100 | 930 | 650 × 30 h, cooled by air |
| 9 | 1100 | 930 | 650 × 12 h, cooled by air |
| 10 | 1100 | 930 | 650 × 14 h, cooled by air |
| 11 | 1100 | 930 | 650 × 15 h, cooled by air |
| 12 | 1100 | 930 | 650 × 30 h, cooled by air |
| 13 | 1100 | 930 | 650 × 32 h, cooled by air |
| 14 | 1100 | 930 | 650 × 20 h, cooled by air |
| 15 | 1100 | 930 | 650 × 24 h, cooled by air |
| 16 | 1100 | 930 | 650 × 33 h, cooled by air |
| 17 | 1100 | 930 | 650 × 35 h, cooled by air |
| 18 | 1100 | 950 | 660 × 20 h, cooled by air |

*1; Annealing temperature (°C.) × 10 h, cooling in oven
*2; Quenching temperature (°C.) × 10 h, 100° C./h cooling The heat-treated samples shown in Table 3 were machined to prepare respective test pieces and these test pieces were subjected to a tensile test, a Charpy impact test, and a creep rupture test. The results of the tensile test and the Charpy impact test are shown in Table 4 and the results of the creep rupture test in Table 5. The tensile test was carried out at normal room temperature. The data obtained in the test with respect to elongation after rupture and reduction of area are additionally shown in Table 4. The Charpy impact test was carried out at a plurality of temperatures in the range of from normal room temperature to 200° C. to determine FATT. The creep rupture test was carried out at 600° C. under two magnitudes of stress, 14 kgf/mm$^2$ and 17 kgf/mm$^2$.

TABLE 4

| | Tensile test | | | | Charpy impact | |
|---|---|---|---|---|---|---|
| | | 0.2% | | | | |
| | Tensile strength (Kgf/mm$^2$) | Proof stress (Kgf/mm$^2$) | Elongation (%) | Reduction of area (%) | Magnitude of impact (Kgf-m/cm$^2$) | FATT *3 (°C.) |
| Example | | | | | | |
| 1 | 88.7 | 74.8 | 23.0 | 59.6 | 13.5 | +12 |
| 2 | 89.5 | 76.7 | 23.0 | 60.5 | 12.3 | +18 |
| 3 | 89.0 | 75.4 | 22.8 | 63.0 | 13.1 | +15 |
| 4 | 88.9 | 74.9 | 22.0 | 61.2 | 13.4 | +7 |
| 5 | 90.2 | 75.5 | 23.2 | 63.4 | 11.8 | +22 |

TABLE 4-continued

| | Tensile test | | | | Charpy impact | |
|---|---|---|---|---|---|---|
| | | 0.2% | | | | |
| | Tensile strength (Kgf/mm$^2$) | Proof stress (Kgf/mm$^2$) | Elongation (%) | Reduction of area (%) | Magnitude of impact (Kgf-m/cm$^2$) | FATT *3 (°C.) |
| 6 | 88.7 | 73.1 | 19.7 | 57.5 | 8.0 | +30 |
| 7 | 87.9 | 73.2 | 20.3 | 59.6 | 10.9 | +24 |
| 8 | 87.5 | 72.8 | 21.0 | 60.4 | 12.1 | +20 |
| 9 | 88.6 | 73.9 | 21.2 | 60.4 | 13.5 | +7 |
| 10 | 89.2 | 74.3 | 23.4 | 63.5 | 14.4 | +2 |
| 11 | 87.8 | 73.8 | 22.6 | 62.7 | 13.0 | +8 |
| 12 | 89.0 | 74.6 | 21.5 | 61.8 | 12.5 | +20 |
| 13 | 88.3 | 74.2 | 19.4 | 60.9 | 8.7 | +45 |
| 14 | 87.6 | 73.7 | 20.7 | 60.4 | 6.9 | +62 |
| Comparative Example | | | | | | |
| 1 | 80.5 | 65.7 | 23.2 | 59.6 | 1.2 | +95 |
| 2 | 92.6 | 77.3 | 23.5 | 66.5 | 20.1 | −20 |
| 3 | 88.3 | 74.2 | 23.7 | 64.7 | 13.5 | +12 |
| 4 | 89.7 | 75.1 | 21.9 | 59.6 | 12.7 | +15 |
| 5 | 88.5 | 74.0 | 22.2 | 63.4 | 13.9 | +10 |
| 6 | 90.2 | 75.5 | 19.7 | 50.2 | 8.4 | +31 |
| 7 | 89.7 | 75.2 | 18.5 | 51.3 | 7.1 | +42 |
| 8 | 88.6 | 73.8 | 18.1 | 48.7 | 6.3 | +56 |
| 9 | 87.6 | 73.5 | 19.2 | 50.8 | 1.1 | +105 |
| 10 | 86.8 | 71.8 | 18.7 | 52.4 | 1.2 | +100 |
| 11 | 87.3 | 72.6 | 18.5 | 52.4 | 4.5 | +82 |
| 12 | 88.6 | 72.8 | 22.3 | 60.8 | 13.8 | +6 |
| 13 | 89.1 | 73.4 | 21.6 | 59.6 | 15.2 | 0 |
| 14 | 90.0 | 73.8 | 21.6 | 60.8 | 14.7 | +4 |
| 15 | 88.7 | 72.7 | 22.0 | 63.4 | 13.9 | +5 |
| 16 | 86.7 | 71.9 | 18.4 | 51.6 | 1.7 | +90 |
| 17 | 88.3 | 73.0 | 18.0 | 54.7 | 1.3 | +105 |
| 18 | 80.8 | 66.2 | 22.5 | 63.4 | 7.6 | +45 |

*3; Ductility · brittleness transition temperature found from the fracture ratio of the samples

TABLE 5

| | Creep rupture test (Test temperature: 600° C.) | | | | | |
|---|---|---|---|---|---|---|
| | Stress: 14 Kgf/mm$^2$ | | | Stress: 17 Kgf/mm$^2$ | | |
| | Creep rupture time (h) | Elongation (%) | Reduction of area (%) | Creep rupture time (h) | Elongation (%) | Reduction of area (%) |
| Example | | | | | | |
| 1 | 3258.1 | 29.4 | 57.0 | 1507.1 | 27.9 | 66.0 |
| 2 | 3908.3 | 31.2 | 60.7 | 1681.4 | 27.4 | 65.5 |
| 3 | 3381.7 | 29.5 | 58.5 | 1576.0 | 30.1 | 69.2 |
| 4 | 3195.6 | 29.5 | 57.0 | 1516.8 | 28.1 | 66.3 |
| 5 | 4191.0 | 28.5 | 55.6 | 1783.3 | 27.0 | 65.5 |
| 6 | 3827.3 | 27.8 | 58.5 | 1821.7 | 26.4 | 64.1 |
| 7 | 3734.5 | 28.4 | 59.3 | 1759.7 | 27.0 | 65.4 |
| 8 | 3516.3 | 28.0 | 58.5 | 1618.7 | 28.7 | 66.3 |
| 9 | 3093.7 | 29.5 | 61.4 | 1472.3 | 27.5 | 65.4 |
| 10 | 3017.6 | 28.6 | 59.3 | 1320.8 | 25.4 | 63.0 |
| 11 | 3420.6 | 28.6 | 60.8 | 1576.2 | 27.3 | 65.3 |
| 12 | 3831.4 | 26.9 | 55.7 | 1786.7 | 28.0 | 66.1 |
| 13 | 4116.7 | 27.8 | 56.1 | 2014.9 | 28.5 | 66.1 |
| 14 | 4926.1 | 26.1 | 54.8 | 2247.6 | 28.8 | 67.2 |
| Comparative Example | | | | | | |
| 1 | 3502.1 | 35.0 | 65.2 | 1480.2 | 36.8 | 74.8 |
| 2 | 213.0 | 30.8 | 60.7 | 84.5 | 34.5 | 74.0 |

TABLE 5-continued

| | Creep rupture test (Test temperature: 600° C.) | | | | | |
|---|---|---|---|---|---|---|
| | Stress: 14 Kgf/mm² | | | Stress: 17 Kgf/mm² | | |
| | Creep rupture time (h) | Elongation (%) | Reduction of area (%) | Creep rupture time (h) | Elongation (%) | Reduction of area (%) |
| 3 | 821.4 | 30.1 | 59.6 | 321.7 | 30.1 | 65.7 |
| 4 | 1107.8 | 28.4 | 58.4 | 514.3 | 31.3 | 67.4 |
| 5 | 1823.2 | 33.2 | 62.3 | 723.4 | 32.7 | 68.7 |
| 6 | 2241.2 | 35.1 | 65.2 | 817.6 | 29.2 | 65.2 |
| 7 | 1817.3 | 29.7 | 63.7 | 742.6 | 34.3 | 70.3 |
| 8 | 1072.4 | 34.7 | 63.4 | 526.7 | 29.5 | 66.3 |
| 9 | 5011.4 | 28.1 | 58.4 | 2387.0 | 31.0 | 67.4 |
| 10 | 4423.5 | 26.4 | 55.7 | 2143.5 | 30.5 | 65.7 |
| 11 | 4106.5 | 27.7 | 58.5 | 2014.1 | 28.6 | 63.1 |
| 12 | 1019.4 | 31.6 | 62.4 | 500.4 | 33.5 | 68.5 |
| 13 | 823.3 | 35.8 | 64.7 | 389.2 | 35.1 | 69.2 |
| 14 | 1208.5 | 30.6 | 60.7 | 526.9 | 35.0 | 68.8 |
| 15 | 1620.4 | 32.4 | 62.3 | 617.4 | 33.7 | 64.7 |
| 16 | 5160.7 | 26.0 | 57.2 | 2533.4 | 28.2 | 63.1 |
| 17 | 5315.4 | 24.2 | 55.0 | 2581.5 | 27.6 | 63.5 |
| 18 | 3140.1 | 25.7 | 63.0 | 1289.0 | 34.6 | 71.6 |

The data obtained of FATT, creep rupture time, and "ratio of segregation" as described above were correlated severally to Mo content, Ni content, and W content. The results are shown respectively in FIG. 1, FIG. 2, and FIG. 3.

With respect to Comparative Examples 1, 2, 3, 5, 6, 8, and 18 and Examples 1 through 3, ingots of 500 kg were prepared severally and analyzed for C (carbon) content in the central part to permit the evaluation of the degrees of componential segregation of C (carbon) in the central parts of high pressure-low pressure single cylinder turbine rotors to be manufactured from the ingots. The ingots were further tested for "ratio of segregation," i.e. the ratio of the C (carbon) content % in the lower part of an ingot to the C (carbon) content % in the upper part. The results are shown in Table 6.

TABLE 6

| | Ratio of segregation |
|---|---|
| Example | |
| 1 | 1.16 |
| 2 | 1.19 |
| 3 | 1.21 |
| Comparative Example | |
| 1 | 1.12 |
| 2 | 1.11 |
| 3 | 1.13 |
| 5 | 1.12 |
| 6 | 1.53 |
| 8 | 1.82 |
| 18 | 1.13 |

To determine the effect of ESR on the componential segregation, ESR ingots of 2 tons were severally prepared with respect to Examples 1, 2, and 3 and were tested for C (carbon) content in the central part. As a result, the "ratio of segregation" found for Example 1 was 1.03, that for Example 2 was 1.06, and that for Example 3 was 1.07. The data clearly indicate that the use of ESR was effective in decisively lowering the componential segregation as compared with the data of Table 6 covering experiments using no ESR.

With respect to Comparative Examples 1, 2, and 18 and Example 2, 4, 7, 8, 11, 12, and 13, the tensile test was carried out after $10^3$ hours' and $10^4$ hours' heating at 600° C. and the Charpy impact test was carried out after $10^3$ hours' and $10^4$ hours' heating at 400° C. on the respective test pieces for the purpose of rating the degradation of strength and that of toughness by aging. The results of the tensile test are shown in Table 7 and FIG. 4 and the results of the Charpy impact test in Table 8 and FIG. 5.

TABLE 7

| | Tensile strength (Kgf/mm²) | | |
|---|---|---|---|
| | As-received | After heating at 600° C., $10^3$ h | After heating at 600° C., $10^4$ h |
| Example | | | |
| 2 | 89.5 | 88.4 | 87.6 |
| 4 | 88.9 | 88.2 | 87.0 |
| 7 | 87.9 | 87.1 | 86.4 |
| 8 | 87.5 | 86.2 | 86.0 |
| 11 | 87.8 | 87.2 | 86.8 |
| 12 | 89.0 | 87.8 | 87.0 |
| 13 | 88.3 | 87.5 | 86.7 |
| Comparative Example | | | |
| 1 | 80.5 | 76.7 | 75.2 |
| 2 | 92.6 | 87.8 | 84.0 |
| 18 | 80.8 | 75.9 | 75.4 |

TABLE 8

| | Charpy impact test | | | | | |
|---|---|---|---|---|---|---|
| | As-received | | After heating at 400° C., $10^3$ h | | After heating at 400° C., $10^4$ h | |
| | Impact Value (Kgf-m/cm²) | FATT (°C.) | Impact Value (Kgf-m/cm²) | FATT (°C.) | Impact Value (Kgf-m/cm²) | FATT (°C.) |
| Example | | | | | | |
| 2 | 12.3 | +18 | 11.2 | +24 | 11.2 | +25 |
| 4 | 13.4 | +7 | 11.4 | +14 | 12.8 | +10 |
| 7 | 10.9 | +24 | 10.7 | +27 | 11.0 | +21 |
| 8 | 12.1 | +20 | 11.8 | +23 | 10.9 | +28 |
| 11 | 13.0 | +8 | 12.7 | +10 | 12.6 | +13 |
| 12 | 12.5 | +20 | 12.1 | +22 | 12.0 | +23 |
| 13 | 8.7 | +45 | 7.9 | +48 | 8.2 | +49 |
| Comparative Example | | | | | | |
| 1 | 1.2 | +95 | 0.8 | +119 | 0.7 | +128 |
| 2 | 20.1 | −20 | 13.0 | +18 | 10.5 | +37 |
| 18 | 7.6 | +45 | 5.7 | +63 | 4.0 | +72 |

Now, the test results mentioned above will be discussed hereinbelow.

In order for the high pressure-low pressure single cylinder turbine rotor of this invention to exhibit high tensile strength under a steam condition of relatively low temperature and high creep rupture strength under a high temperature condition and retain the high tensile strength and the high creep rupture strength for a long time without entraining the phenomenon of embrittlement, it is desired to possess the following characteristic values. As initial values, the tensile strength is desired to be in the range of from 86 to 92 kgf/mm$^2$, the 0.2% proof stress to be in the range of from 71 to 77 kgf/mm$^2$, the elongation to be not less than 18%, the reduction of area to be not less than 55%, the impact value to be not less than 6 kgf-m/cm$^2$, and the FATT to be not more than 70° C. Under the condition of creep of 600° C.×14 kgf/mm$^2$, the rupture time is desired to be not less than 2500 hours, the elongation to be not less than 20%, and the reduction of area to be not less than 50%. Under the condition of creep of 600° C.×17 kgf/mm$^2$, the rupture time is desired to be not less than 1000 hours, the elongation to be not less than 20%, and the reduction of area to be not less than 50%.

The working examples cited above invariably satisfied the characteristic values mentioned above. In the characteristic values, the tensile strength was on an equal level in all the examples because the magnitudes thereof obtained in the examples were practically equalized by varying the tempering conditions with individual test pieces. Accordingly, the magnitudes of 0.2% proof stress were on a practically equal level. The magnitudes of elongation and reduction of area exhibited by the test pieces were on practically equal levels because they were not notably affected by delicate changes of alloy elements. The impact value and the FATT property which designate toughness are affected largely by the kinds and the amounts of elements to be incorporated. Particularly, Cr, Ni, and Nb, when incorporated in increased amounts, are effective in improving the toughness. W and Mo, when incorporated in increased amounts, degrade the toughness. For the purpose of notably decreasing the amount of grain boundary segregation and repressing the embrittlement due to aging during a protracted use of the rotor, the amount of inevitable impurities must be limited to the fullest possible extent. The components are also restricted from the viewpoint of creep rupture strength (time) and componential segregation of carbon. For the contents of the components in the steel of this invention, the following desirable ranges are set. Cr: 1.5 to 3.0%, Ni: 1.0 to 2.0%, Nb: 0.01 to 0.15%, W: 0.1 to 1.5%, and Mo: 0.9 to 1.3% and, in the inevitable impurities, P: not more than 0.005%, S: not more than 0.01%, As: not more than 0.008%, Sb: not more than 0.004%, and Sn: not more than 0.008%. These ranges suffice to satisfy fully the characteristic values mentioned above.

Example 6 showed a relatively low impact value probably because Ni which is effective in improving toughness was incorporated in a small amount as compared with other examples. Example 14 showed lower impact value than Example 6, though it incorporated Ni in a larger amount than Example 6. This was probably because the toughness was lowered in proportion as the amount of W incorporated in Example 14 was increased.

In Table 5, Comparative Examples 9, 10, 11, 16, and 17 showed more desirable creep rupture times than the working examples of this invention. Since Comparative Examples 9, 10, and 11 incorporated Ni in amounts of not more than 1.0% and Comparative Examples 16 and 17 incorporated W in amounts of not less than 1.5%, they failed to satisfy the aforementioned characteristic values of impact value and FATT property which designate toughness and, therefore, showed low magnitudes of toughness.

Now, the cases of varying the contents of Mo, Ni, and W while confining the contents of inevitable impurities within the aforementioned ranges will be discussed below.

First, Comparative Examples 1 through 8 and Examples 1 through 5 which varied the content of Mo and confined the contents of inevitable impurities within the ranges mentioned above will be described below.

From the test results shown in Table 4, it is noted that Examples 1 through 5 equaled or surpassed Comparative Examples 1 through 8 in tensile strength, proof stress, elongation, and reduction of area and manifested sufficient mechanical properties at relatively low temperatures. Particularly these examples invariably showed markedly improved strength, low FATT, and high toughness as compared with Comparative Example 1. Then, from the test results shown in Table 5, it is remarked that Examples 1 through 5 exhibited decisively satisfactory creep rupture times as compared with Comparative Examples 2 through 8 and showed properties favorably comparable with Comparative Example 1 representing a conventional high pressure turbine rotor. It is noted from the test results of Table 6 that Examples 1 through 3 conforming to this invention showed "ratios of segregation" decisively small as compared with Comparative Examples 6 and 8 and practically equal to Comparative Examples 1 and 2 representing respectively a conventional high pressure turbine rotor and a conventional low pressure turbine rotor. This fact indicates that the turbine rotors according to this invention have no problem concerning the componential segregation from the viewpoint of manufacture. FIG. 1 depicts the correlations of these test results to the Mo content. It is noted from this diagram that the characteristics of toughness, creep rupture time, and "ratio of segregation" are invariably very satisfactory when the Mo contents are in the range of from 0.9 to 1.3.

Now, Comparative Examples 1 and 9 through 13 and Examples 6 through 9 which varied Ni content and confined the contents of the inevitable impurities within the ranges mentioned above will be described below.

Figure 2:
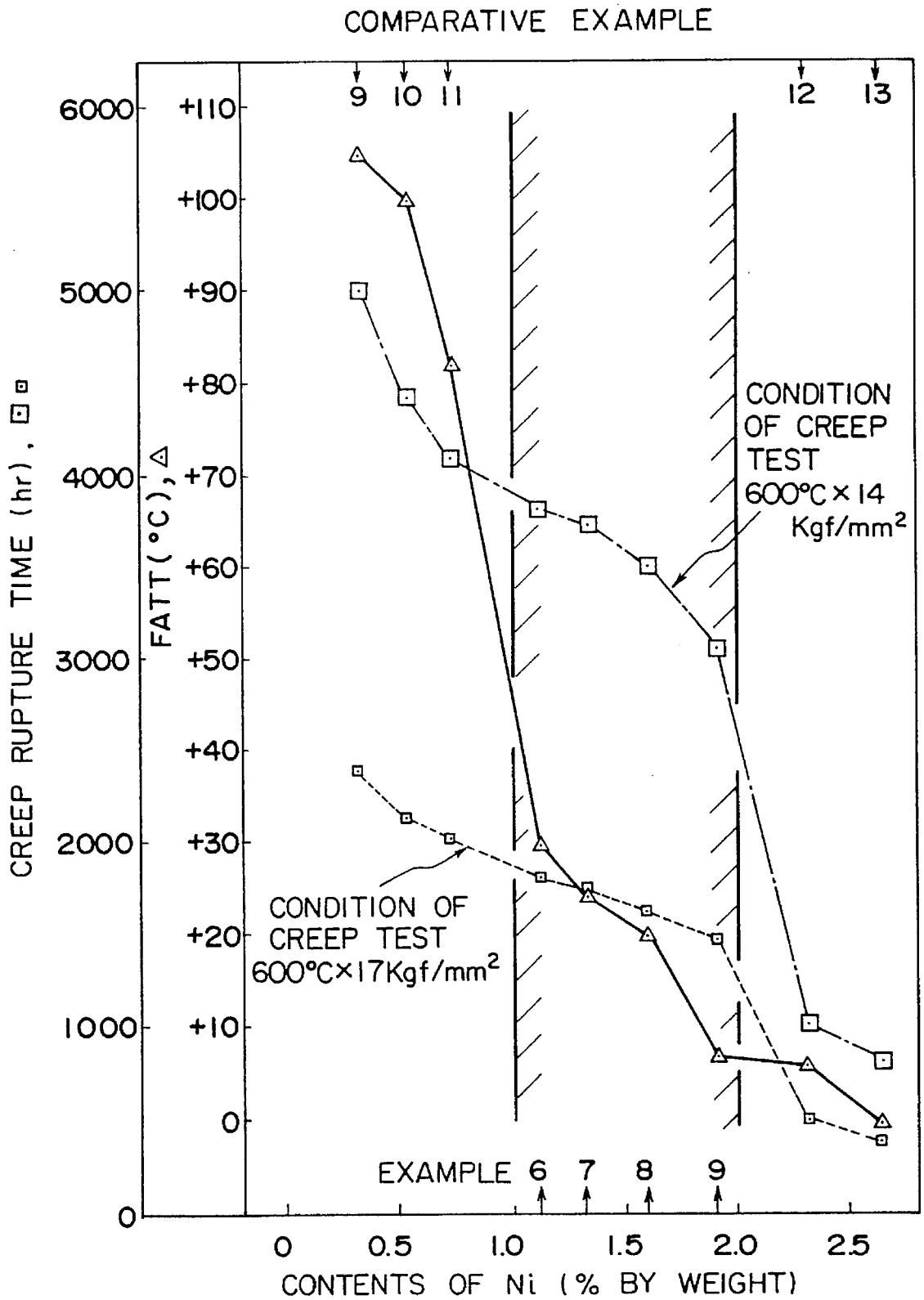
FIG. 2 is a diagram showing the results of the correlation of FATT and creep rupture time severally to the Ni content.

It is noted from the test results shown in Table 4 that Examples 6 through 9 conforming to this invention likewise equaled or surpassed Comparative Examples 1 and 9 through 13 in tensile strength, proof stress, elongation, and reduction of area. This fact indicates that they possessed fully satisfactory mechanical properties at relative low temperatures. Examples 6 through 9 in particular showed marked improved strength, repressed FATT, and improved toughness as compared with Comparative Example 1. Further, Examples 6 through 9 showed repressed FATT and conspicuously improved toughness as compared with Comparative Examples 9 through 11. It is noted from the test results shown in Table 5 that Examples 6 through 9 conforming to this invention exhibited decisively satisfactory creep rupture times as compared with Comparative Examples 12 and 13 and they possessed characteristic properties favorably comparable with Comparative Example 1 representing a conventional high pressure turbine rotor. FIG. 2 depicts the correlations of these test results to Ni content. It is found from this diagram that the characteristic properties of toughness and creep rupture time are highly satisfactory when the Ni contents are in the range of from 1.0 to 2.0%.

Then, Comparative Examples 1 and 14 through 17 and Examples 10 through 14 which varied the W content and repressed the contents of the inevitable impurities within the ranges mentioned above will described below.

Figure 3:
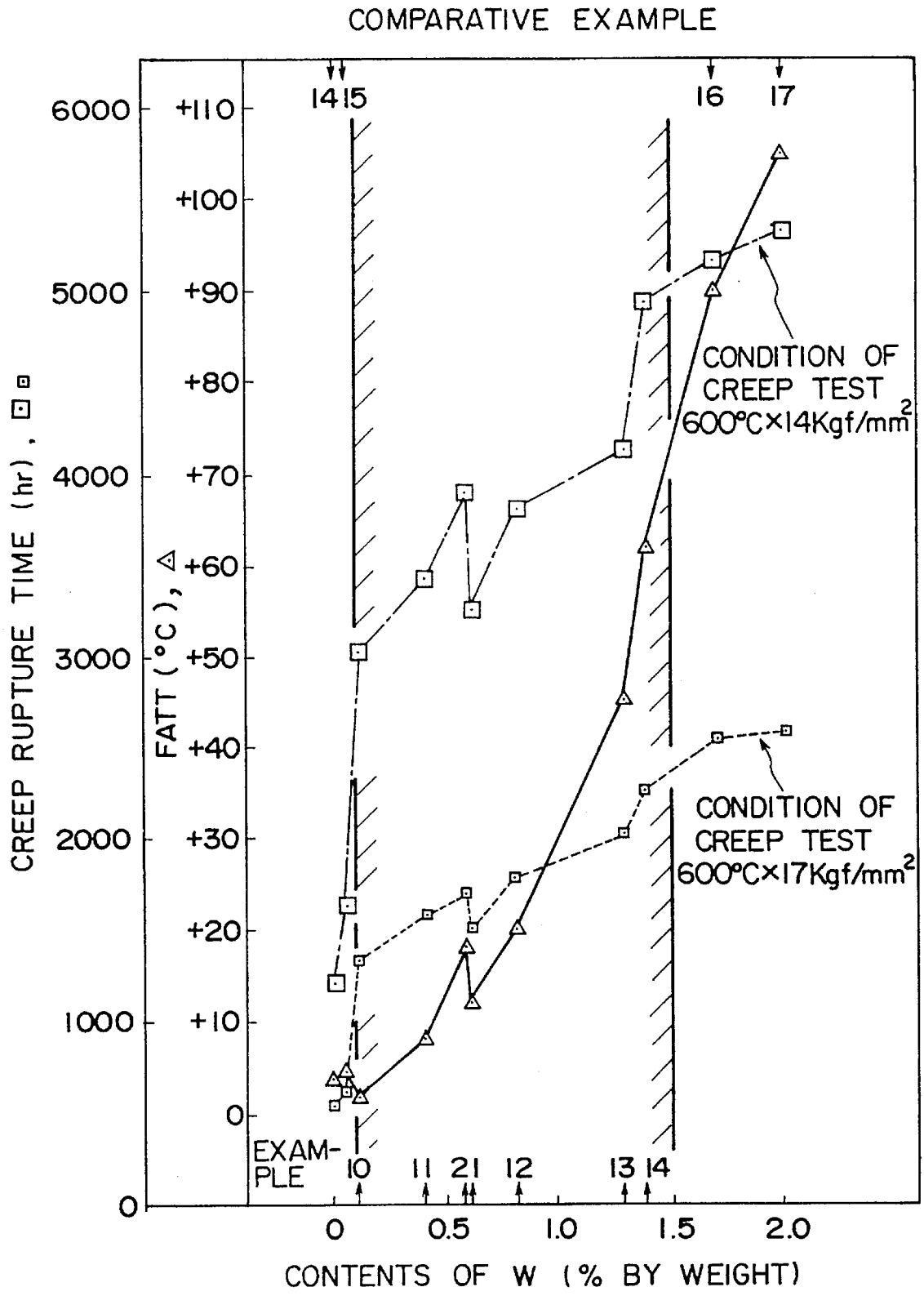
FIG. 3 is a diagram showing the results of the correlation of FATT and creep rupture time severally to the W content.

From the test results shown in Table 4, it is remarked that Examples 1 and 2 and 10 through 14 conforming to this invention likewise equaled or surpassed Comparative Examples 1 and 14 through 17 in tensile strength, proof stress, elongation, and reduction of area. This fact indicates that they exhibited fully satisfactory mechanical properties at relatively low temperatures. Examples 1, 2 and 10 through 14 in particular showed marked improved strength, repressed FATT, and improved toughness as compared with Comparative Example 1. Further, Examples 1, 2 and 10 through 14 showed repressed FATT and conspicuously improved toughness as compared with Comparative Examples 16 and 17. It is noted from the test results shown in Table 5 that Examples 1, 2 and 10 through 14 conforming to this invention exhibited decisively satisfactory creep rupture times as compared with Comparative Examples 14 and 15 and they possessed characteristic properties favorably comparable with Comparative Example 1 representing a conventional high pressure turbine rotor. FIG. 3 depicts the correlations of these test results to W content. It is found from this diagram that the characteristic properties of toughness and creep rupture time are highly satisfactory when the W contents are in the range of from 0.1 to 1.5%.

Figure 4:
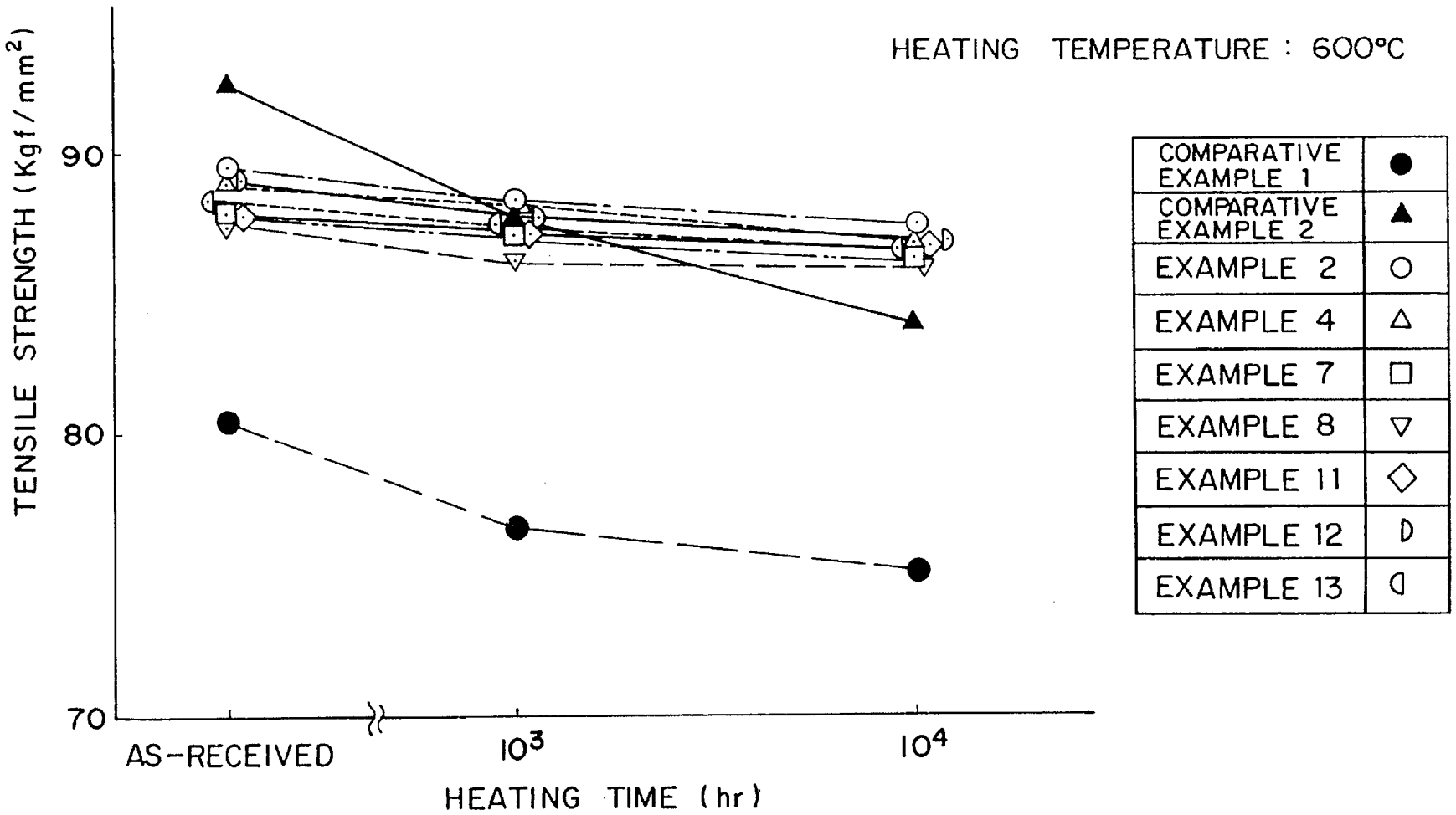
FIG. 4 is a diagram showing the relation between the heating time at 600° C. and the tensile strength.

From Table 7 and FIG. 4 showing the results of the rating of the decrease of tensile strength due to aging among other strength properties, it is noted that Comparative Examples 1 and 2 showed large decreases of tensile strength due to aging; after the aging of 600° C.×$10^4$ hours, Comparative Example 1 showed a decrease of 5.3 kgf/$mm^2$ and Comparative Example 2 a decrease of 8.6 kgf/$mm^2$ respectively in tensile strength. In contrast, the examples of the invention showed decreases of tensile strength in the range of from 1 to 2 kgf/$mm^2$. This fact indicates that these examples were markedly improved in tensile strength over the Comparative Examples representing conventional materials. The incorporation of W constitutes itself one of the characteristic features of the species of steel conforming to this invention. It is thought that the tungsten forms a solid solution in the matrix and fulfills the role of not only exalting the tensile strength and the creep rupture strength but also improving the stability of the texture and repressing the variation of strength due to aging. Comparative Example 1 showed a large variation of strength due to aging as compared with Comparative Example 2, probably because of a difference in the Ni content. Ni is an element which is unusually effective in heightening toughness and nevertheless is an element which aggravates the degradation of strength at high temperatures. Since this invention sets the upper limit of the Ni content at 2.0%, the effect of Ni coupled with the effect of W manifested in stabilizing the texture enables the variation of tensile strength due to aging to be repressed to an extremely low level.

Figure 5:
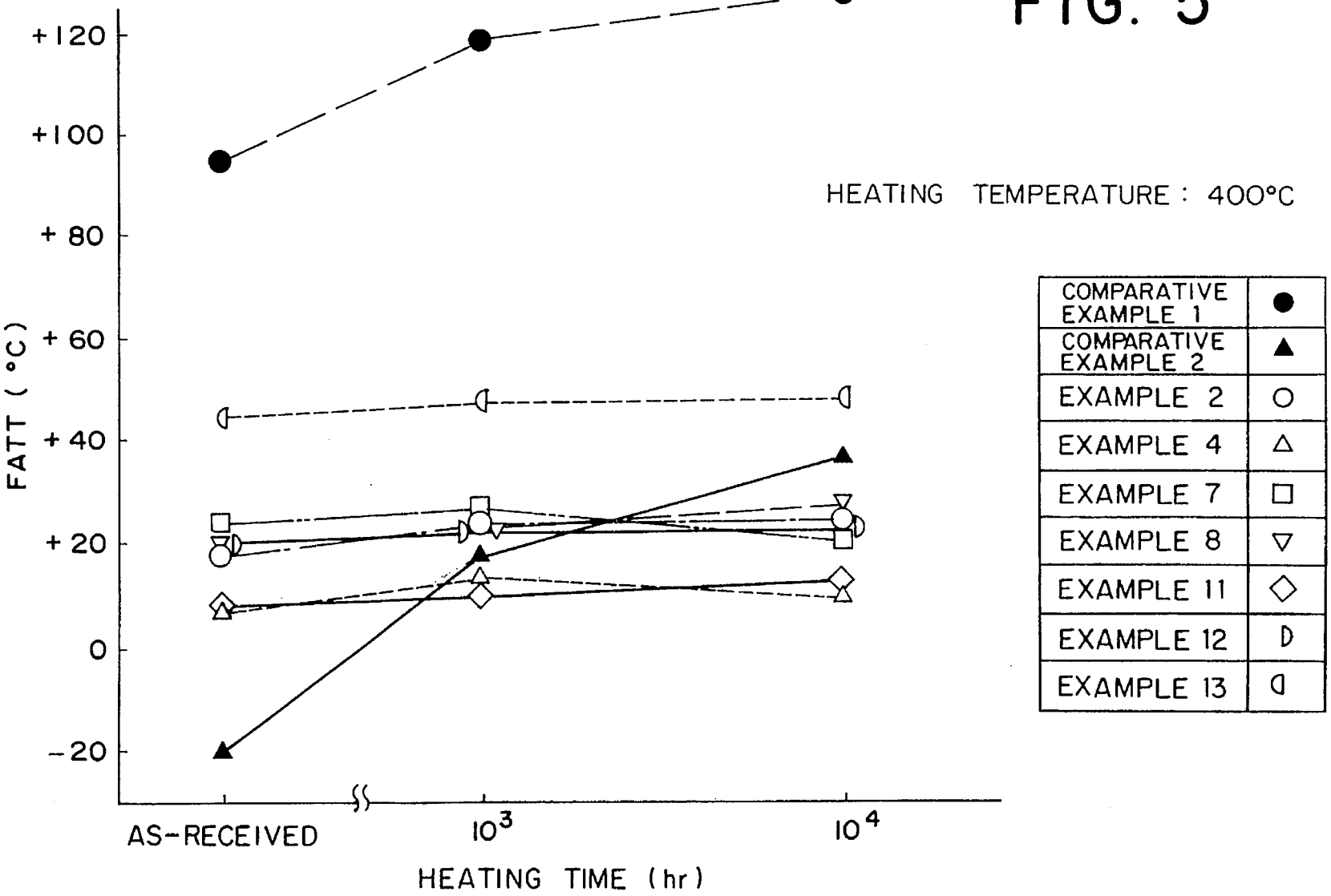
FIG. 5 is a diagram showing the relation between the heating time at 400° C. and FATT.
Figure 6:
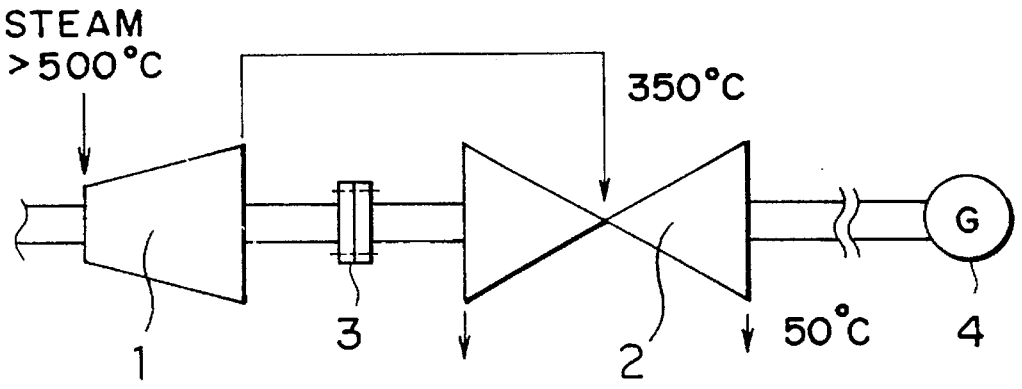
FIG. 6 is an explanatory diagram for illustrating one example of a steam turbine using a conventional turbine rotor.
Figure 7:
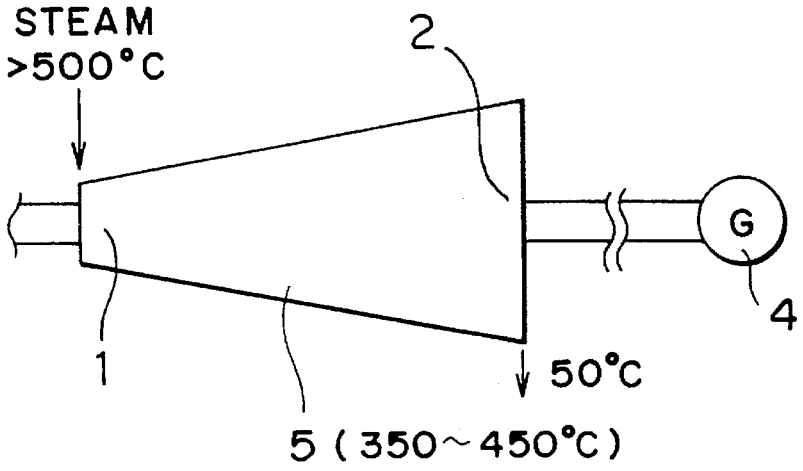
FIG. 7 is an explanatory diagram for illustrating one example of a steam turbine incorporating a high pressure-low pressure single cylinder rotor.

From Table 8 and FIG. 5 showing the results of the rating of the decrease of tensile strength due to aging, it is remarked that Comparative Examples 1 and 2 showed large degrees of embrittlement; after the heat treatment of 400° C.×$10^4$, Comparative Example 1 showed an increase of 33° C. and Comparative Example 2 an increase of 57° C. respectively in FATT. In contrast, the examples of this invention showed increases of FATT in the range of from −3° to +7° C. This fact indicates that the examples were markedly improved in terms of the decrease of toughness by aging as compared with the Comparative Examples representing the conventional materials. The rotors made of the species of steel conforming to this invention, even after a protracted use, repress the amount of grain boundary segregation of impurities and curb the phenomenon of embrittlement due to aging because the contents of P, S, As, Sb, and Sn among other inevitable impurities are limited to extremely small amounts. Comparative Example 2 showed a large degree of embrittlement as compared with Comparative Example 1, probably because of a difference in the Ni content similarly to the case of the degradation of strength mentioned above. To be specific, Ni is an element which is unusually effective in exalting toughness and nevertheless is an element which aggravates the phenomenon of embrittlement at temperatures in the neighborhood of 350° C. to 450° C. Since the upper limit of the Ni content is set at 2.0%, the phenomenon of embrittlement due to aging can be curbed to an extremely low level owing to the effect of Ni coupled with the effect manifested in repressing the amount of grain boundary segregation by the fact that the contents of the inevitable impurities are limited to extremely small amounts.

In the light of the discussion given above, it can be concluded that Examples 4 and 6 through 9 constitute themselves preferred embodiments for the high pressure-low pressure single cylinder turbine rotor contemplated by this invention.

What is claimed is:

1. A high pressure-low pressure single cylinder turbine rotor comprising an electroslag remelted steel consisting essentially of, by weight, a C content in the range of from 0.2 to 0.27%, a Si content of not more than 0.1%, (not including 0%), a Mn content of not more than 0.7% (not including 0%), a Ni content in the range of from 1.5 to 1.8%, a Cr content in the range of from 2.0 to 2.3%, a Mo content in the range of from 1.0 to 1.2%, a V content in the range of from 0.18 to 0.23%, a Nb content in the range of from 0.02 to 0.05%, a W content in the range of 0.2 to 0.5%, and the balance of Fe and inevitable impurities, said inevitable impurities having a P content of not more than 0.005%, a S content of not more than 0.001%, an As content of not more than 0.004%, and a Sn content of not more than 0.008%, whereby segregation of carbon in a central portion of the turbine rotor is reduced over the segregation resulting in the absence of electroslag remelting.

2. The high pressure-low pressure single cylinder turbine rotor according to claim 1, wherein said steel has characteristic values of tensile strength in the range of from 86 to 92 kgf/$mm^2$ FATT of not more than 70° C., and rupture time of not less than 2500 hours under creep conditions of 600° C.×14 kgf/$mm^2$.

3. The high pressure-low pressure single cylinder turbine rotor according to claim 2, wherein said FATT value is not more than +45° C.

4. The high pressure-low pressure single cylinder turbine rotor according to claim 2, wherein said steel has characteristic value of 0.2% proof stress in the range of from 71–77 kgf/$mm^2$, elongation not less than 18%, reduction of area not less than 55%, and impact value not less htan 6 kgf-m/$cm^2$.

5. A method for the production of a high pressure-low pressure single cylinder turbine rotor steel consisting essentially of, by weight, a C content of from 0.2 to 0.27%, a Si content of not more than 0.1% (not including 0%), a Mn content of not more than 0.7% (not including 0%), a Ni content of from 1.5 to 1.8%, a Cr content of from 2.0 to 2.3%, a Mo content of from 1.0 to 1.2%, a V content of from 0.18 to 0.23%, a Nb content of from 0.02 to 0.05%, a W content of from 0.2 to 0.5%, and the balance of Fe and inevitable impurities, said inevitable impurities having a P content of not more than 0.005%, a S content of not more than 0.001%, an As content of not more than 0.008%, a Sb content of not more than 0.004%, and a Sn content of not more than 0.008%, which method comprises the steps of melting a steel material possessing said composition in a melting furnace thereby preparing a primary steel ingot, remelting and casting said primary steel ingot by the electroslag remelting technique, thereby forming a secondary steel ingot, forging said secondary steel ingot, thereby producing a forged mass in the shape of a rotor, and subjecting said forged mass in the shape of a rotor to annealing, quenching, and tempering treatments, wherein segregation of carbon in a central portion of the rotor is reduced over the segregation resulting in the absence of said steps.

6. A high pressure-low pressure single cylinder turbine rotor comprising an electroslag remelted steel consisting essentially of, by weight, a C content in the range of from 0.2 to 0.27%, a Si content of not more than 0.1% (not including 0%), a Mn content of not more than 0.7% (not including 0%), a Ni content in the range of from 1.5 to 1.8%, a Cr content in the range of from 2.0 to 2.3%, a Mo content in the range of from 1.0 to 1.3%, a V content in the range of from 0.18 to 0.23%, a Nb content in the range of from 0.02 to 0.05%, a W content in the range of 0.1 to 0.5%, and the balance of Fe and inevitable impurities, said inevitable impurities having a P content of not more than 0.005%, a S content of not more than 0.001%, an As content of not more than 0.008%, a Sb content of not more than 0.004%, and a Sn content of not more than 0.008%, whereby segregation of carbon in a central portion of the turbine rotor is reduced over the segregation resulting in the absence of electroslag remelting.

7. A method for the production of a high pressure-low pressure single cylinder turbine rotor steel consisting essentially of, by weight, a C content of from 0.2 to 0.27%, a Si content of not more than 0.1% (not including 0%), a Mn content of not more than 0.7% (not including 0%), a Ni content of from 1.5 to 1.8%, a Cr content of from 2.0 to 2.3%, a Mo content of from 1.0 to 1.3%, a V content of from 0.18 to 0.23%, a Nb content of from 0.02 to 0.5%, a W content of from 0.1 to 0.5%, and the balance of Fe and inevitable impurities, said inevitable impurities having a P content of not more than 0.005%, a S content of not more than 0.001%, an As content of not more than 0.008%, a Sb content of not more than 0.005%, and a Sn content of not more than 0.008%, which method comprises the steps of melting a steel material possessing said composition in a melting furnace thereby preparing a primary steel ingot, remelting and casting said primary steel ingot by the electroslag remelting technique thereby forming a secondary steel ingot, forging said secondary steel ingot thereby producing a forged mass in the shape of a rotor, and subjecting said forged mass to annealing, quenching, and tempering treatments, whereby segregation of carbon in a central portion of the rotor is reduced over the segregation result in the absence of said steps.

8. A high pressure-low pressure single cylinder turbine rotor according to claim 5 or claim 6, wherein a ratio of segregation is 1.10 or less, the ratio of segregation being defined as the ratio of the C content % in the central portion of said rotor to the content % in the remaining portion of the rotor.

* * * * *

UNITED STATES PATENT AND TRADEMARK OFFICE

CERTIFICATE OF CORRECTION

PATENT NO. : 5,611,873

DATED : March 18, 1997

INVENTOR(S) : Masayuki YAMADA et al.

It is certified that error appears in the above-indentified patent and that said Letters Patent is hereby corrected as shown below:

Claim 2, column 18, line 35, after "92kgf/mm $^2$ ", insert --,-- (a comma).

Claim 4, column 18, line 45, "htan" should read --than--.

Signed and Sealed this

Nineteenth Day of August, 1997

*Attest:*

*Attesting Officer*

Bruce Lehman

BRUCE LEHMAN

*Commissioner of Patents and Trademarks*